US011488502B2

(12) United States Patent
Klevana et al.

(10) Patent No.: US 11,488,502 B2
(45) Date of Patent: Nov. 1, 2022

(54) TELESCOPING FLAGPOLE FLAG CLIPS

(71) Applicant: Dynamic Brands, LLC, Richmond, VA (US)

(72) Inventors: Leighton Klevana, Richmond, VA (US); Patrick Gallagher, Midlothian, VA (US)

(73) Assignee: Dynamic Brands, LLC, Richmond, VA (US)

( * ) Notice: Subject to any disclaimer, the term of this patent is extended or adjusted under 35 U.S.C. 154(b) by 530 days.

(21) Appl. No.: 16/272,306

(22) Filed: Feb. 11, 2019

(65) Prior Publication Data

US 2019/0251880 A1 Aug. 15, 2019

Related U.S. Application Data

(60) Provisional application No. 62/628,392, filed on Feb. 9, 2018.

(51) Int. Cl.
*G09F 17/00* (2006.01)

(52) U.S. Cl.
CPC ..... *G09F 17/00* (2013.01); *G09F 2017/005* (2013.01); *G09F 2017/0058* (2013.01)

(58) Field of Classification Search
CPC ..... G09F 17/00; G09F 2017/0058; G09F 2017/005
See application file for complete search history.

(56) References Cited

U.S. PATENT DOCUMENTS 2,799,240 A * 7/1957 Andrews ..... E04H 12/32 116/174
3,706,297 A * 12/1972 Voorhees ..... G09F 17/0091 116/174
4,918,896 A * 4/1990 Wiese ..... E04H 12/182 52/632
5,375,555 A * 12/1994 Dolan ..... G09F 17/00 116/174
5,522,342 A * 6/1996 Chen-Chao ..... G09F 17/00 116/174
5,572,835 A * 11/1996 Atkins ..... G09F 17/00 116/173
5,806,819 A * 9/1998 Martone ..... F16B 2/10 24/16 PB
5,943,980 A * 8/1999 Huang ..... G09F 17/00 116/174
6,976,447 B2 * 12/2005 Spiegel ..... G09F 17/00 116/173
7,017,512 B2 * 3/2006 Laird ..... G09F 17/00 116/173
7,575,209 B1 * 8/2009 Wiese ..... E04H 12/32 248/218.4

(Continued)

*Primary Examiner* — Nimeshkumar D Patel
*Assistant Examiner* — Tania Courson
(74) *Attorney, Agent, or Firm* — Pike IP Law; Bernard G. Pike

(57) ABSTRACT

An adjustable telescoping flagpole that has a plurality of hollow tube sections and a plurality of flagpole clips. The telescoping flagpole may be extended and locked at any point from the fully extended length to the fully compacted length. Each telescoping section of the flagpole has a fixed flagpole clip at the top of the telescoping section and an adjustable clip that may be moved along the telescoping section to produce a flagpole of a desired length.

9 Claims, 4 Drawing Sheets

(56) References Cited

U.S. PATENT DOCUMENTS

| | | | | |
|---|---|---|---|---|
| 8,069,811 | B2 * | 12/2011 | Ciaccia | E04H 12/32 116/173 |
| 2010/0101479 | A1 * | 4/2010 | Grahl | E04H 12/32 116/173 |

* cited by examiner

TELESCOPING FLAGPOLE FLAG CLIPS

FIELD OF THE INVENTION

Flagpoles are tall poles used to connect and fly flags well above the ground in a display of pride or patriotism. Many flagpoles allow flying two or more flags. A typical flag comprises at least two grommets that may be clipped to the flagpole by two flag clips. Some flagpoles are a single pole with a fixed length while other flagpoles are telescoping to allow the length of the pole to be altered. A telescoping pole has a fully extended length for use to fly the flag and a fully compacted length for transport or storage. Embodiments of the flagpole comprises at least two telescoping sections, wherein each telescoping section comprises a fixed flagpole clip at the top of the telescoping section and a releasable clip that may be moved along the telescoping section.

BACKGROUND

Telescoping poles have many uses and, generally, comprise multiple hollow tube sections of different diameters wherein the smaller diameter tubes are received within at least one larger diameter tube. The tubes may all be nested within one another or individually slid relative to another tube in a telescoping manner to extend the pole, thereby allowing the pole to be extended and retained at various lengths.

The total length of a telescoping pole is generally based upon the number and length of the individual tube sections that make up the pole and the length of each pole that remains within the pole of next larger diameter. A pole comprised of a greater number of sections of equivalent length will extend farther than a similar pole comprised of fewer sections of the same length. As such, the length of a fully extended telescoping pole may be increased by either increasing the length of the tube sections or by increasing the number of sections.

Two consecutive tube sections can be described as a receiving tube section and a received tube section. The received tube section fits slidably within the receiving tube section. The inner diameter of the receiving tube section is slightly larger than the outer diameter of the received tube section. Each received tube section may also be hollow itself and also be considered to be a receiving tube section relative to a smaller diameter tube. All the tubes may nest in this manner and slidably receiving in another internal section except for the tube section with the greatest diameter and the pole section with the smallest diameter. For a flagpole, the receiving tube section with the largest diameter is the base of the pole and the received tube section with the smallest diameter is the top tube section of the flag pole.

To prevent a telescoping flagpole from reverting to the nested position and remain in the extended position, each individual section of the telescoping pole having a locking mechanism that remains partially within the associated receiving tube section. Whether fully or partially extended, the tube sections of the telescoping pole need to stay affixed in some manner to the adjoining sections so the pole will remain in place once positioned to a desired length. Locking mechanisms are located at the end of each received tube sections to lock the relative positions of neighboring receiving tube sections to retain the telescoping flagpole sufficiently rigid enough to remain in the extended position.

Typically, the locking mechanisms can be switched to the locking position by counter-rotating adjoining sections of the pole or, in other embodiments, by rotating a locking collar threadedly engaged to the receiving tube section. Further, each receiving tube section comprises a cap or cover at the top or junction or joint between two tube sections that may provide a sliding surface for the received section and to cover potential pinch points.

Flagpole clips are used to retain a flag to the top sections of the flagpole must be moved to a position into appropriate to drape a flag properly and then moved again for the flagpole to be compacted to its nested storage position.

There is a need for a telescoping flagpole comprising flagpole clips that are incorporated into parts of the flagpole and function efficiently to allow ease in positioning at least one flag on the flagpole and retaining the flag in the desired position.

There is a further need for a combination cap or cover for the telescoping flagpole sections that incorporate and flagpole clip to simplify and more securely hold the flagpole at the desired length and the flag in the desired location while, in some embodiments, allowing the flag to freely rotate around the flagpole in shifting winds.

DESCRIPTION

The present invention relates generally to adjustable telescoping utility poles comprising a plurality of hollow tube sections and a plurality of flagpole clips. Some flagpoles may be extended and locked at any point from the fully extended length to the fully compacted length. There are various locking mechanisms that may be utilized to lock the flagpole in the desired length.

Telescoping flagpoles comprise a plurality of nesting tube sections wherein each tube section has a different diameter. The diameters of the tube sections are such that the tube sections may nest within each other and pulled out and locked in position to produce a flagpole of the desired length.

Figure 1:
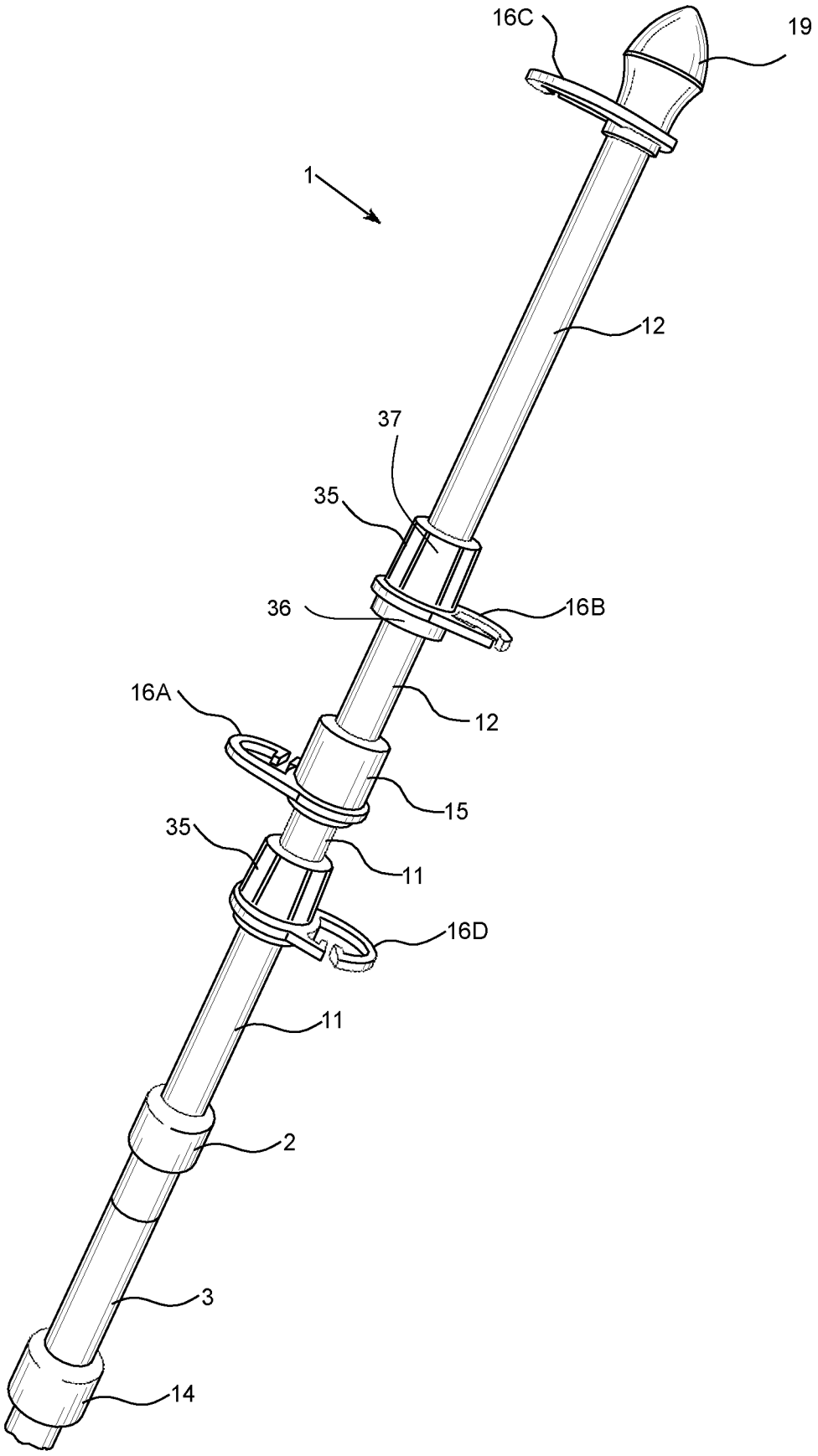
FIG. 1 depicts an embodiment of a flagpole comprising two caps comprising rotatable flagpole clips.
Figure 2:
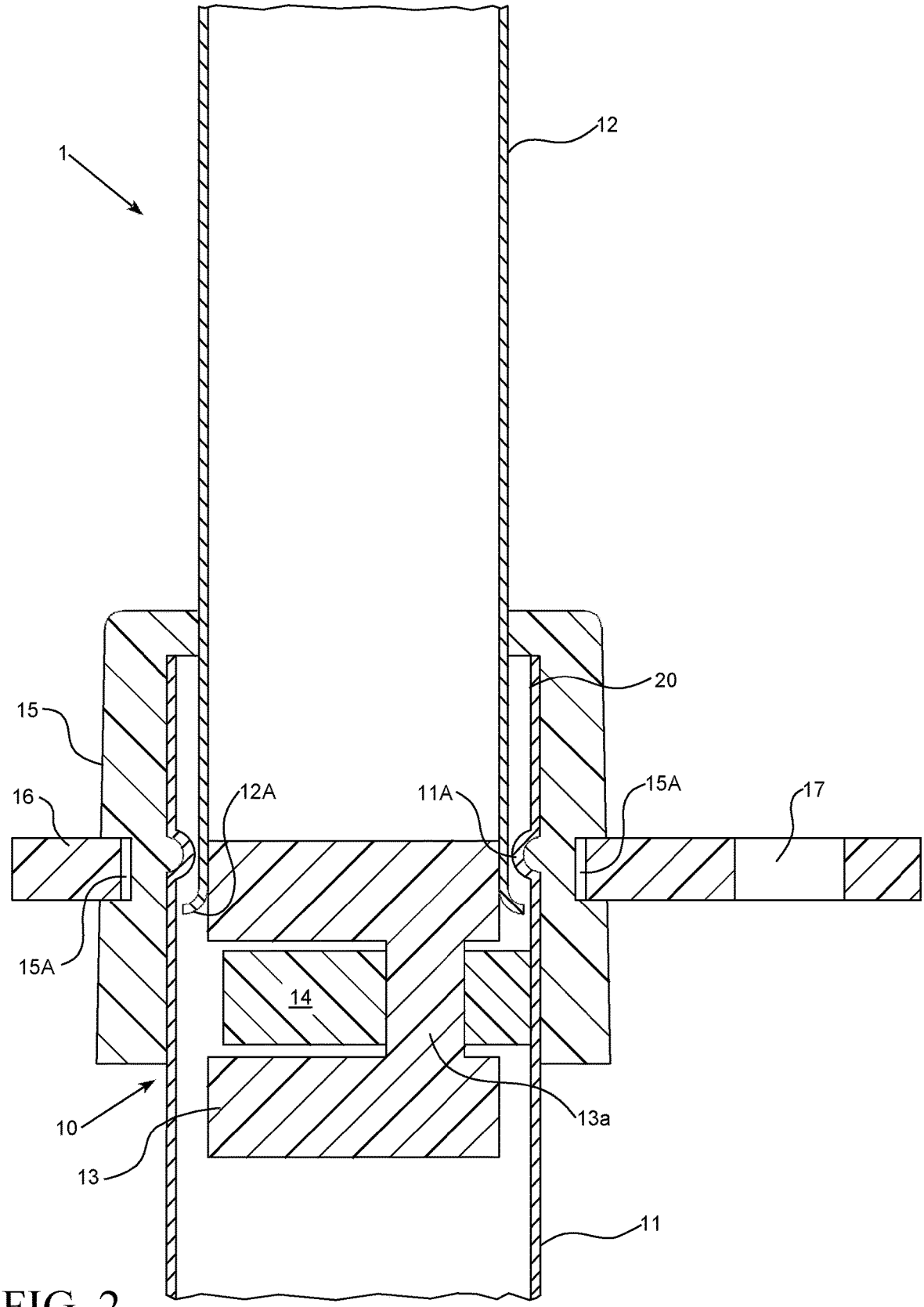
FIG. 2 depicts an enlarged image of a joint between a received tube section 12 and a receiving tube section comprising a cap 15 with a circumferential groove 15A defined in the cap and a flagpole clip 16 rotatably connected within the circumferential groove 15A.

The locking mechanisms may be internal locking mechanisms or external locking mechanisms. An embodiment of a telescoping flagpole is shown in FIG. 1. The flagpole 1 comprises a top tube section 12 with a cap 19 on a top portion of the top tube section 12. The top tube section 12 has an internal locking mechanism 10 connected to the bottom portion of the top tube section 12. The internal locking mechanism is shown in FIG. 2. The internal locking mechanism 10 comprises a locking body 13 having an off-center axle 13A and a locking cam 14. As the top tube section 12 is rotated the off-center axle 13A forces the locking cam 14 against the tube wall of the next tube section, a receiving tube section, 11 to lock the relative positions of the top tube section (received tube section) 12 and the second tube section (receiving tube section) 11 and lock the flagpole in the storage position, the extended position, or at any intermediate position.

Other embodiments of the locking mechanism may also be incorporated into the telescoping flagpole. In embodiments of either internal locking mechanisms or external locking mechanisms, there is a cover or cap 15 over the junction or joint between two adjacent poles where the received tube section is into the receiving tube section. The cover or cap 15 may prevent pinching of the user's skin in the space 20 between the adjacent poles as the received tube section with the smaller diameter is slipped within the receiving tube section 11 with the next larger diameter, to prevent dirt and debris from entering the space 20 of the flagpole where debris may prevent smooth function of the flagpole, and/or to provide a place to grip the receiving tube section 11 as the received tube section 12 is twisted to the engage the locking mechanism. The space 20 may be present to allow a lip 12A on the bottom of the received tube 12 to contact a stop, rib, or other obstruction 11A (stop) on the received tube section 11 to prevent the received tube section 12 from being slid completely out of the receiving tube section 11 after assembly. The lip 12A will contact stop 11A to prevent further movement of the received tube section 12 and separation from the receiving tube section.

Flagpoles also comprise flag clips to secure a flag to the flagpole. Typically, a flag requires an upper flag clip to connect to a top grommet of the flag and a bottom flag clip to connect to a bottom grommet of the flag. The flag may then be displayed in an open position on the flagpole. The clips must be secured to the pole and, preferably, still be able to rotate around the pole to allow the flag to move freely in shifting winds. These two objectives are sometimes in conflict. In addition, for telescoping flagpoles, the clips must be tightly secured to the flagpole to hold the flag in position and, then, released to be able to slide up and down the tube section of the flagpole to allow the telescoping pole received tube section to be moved into the receiving tube section and into its fully compact length. In conventional flagpoles, both the flagpole pole sections must be unlocked, and the flagpole clips must be unsecured from the tube section to allow the flagpole to be compactly stored as designed. After prolonged use, the flag clips may no longer be secured tightly to the flagpole due to wear, for example.

An embodiment of the flagpole clip of the invention is integrated with at least one of the caps on the tube section. The cap may be at least one of the top cap or flagpole cap or finial 19 and the cap 15 at the junction or joint between a received tube section and a receiving tube section. In embodiments, either or all of the following may comprise a flag clip: a component of the locking member for securing the relative location of the two poles, a cover over the junction between two adjacent poles, or other component located at the junction or joint between two adjacent telescoping pole sections of the telescoping flagpole.

An embodiment of the flag pole of the invention is shown in FIG. 1. The flagpole 1 comprises adjacent telescoping pole tube sections 3, 11 and 12. Receiving tube section 11 has a larger diameter that received tube section 12 allowing received tube section 12 to slide within receiving tube section 11. Receiving tube section 3 has the largest diameter of the three shown tube sections 3, 11 and 12 and tube sections 11 and 12 may be received within receiving tube section 3 to transfer the flagpole to the compact storage configuration.

The embodiment of the telescoping flagpole of FIG. 1 has a locking mechanism to secure telescoping tube section 12 relative to telescoping tube section 11, for example, as shown in FIG. 2. The locking mechanism on the embodiment is described above but other locking mechanisms such as pins or other protrusions and holes may be used.

Between the two telescoping tube sections 11 and 12 is a gap 20. Gap 20 is covered with cap cover 15 that prevents damage to the top of pole section 11, prevents debris from getting into gap 20, and prevents pinching of the user when pole sections 11 and 12 are slid relative to each other as described. An embodiment of a flagpole may comprise multiple caps covering such junctions such as second cap or cover 2 on the junction of receiving tube section 3 and received tube section 11. Thus, an intermediate tube section such as tube section 11 may be both a received tube section and a receiving tube section.

Figure 3:
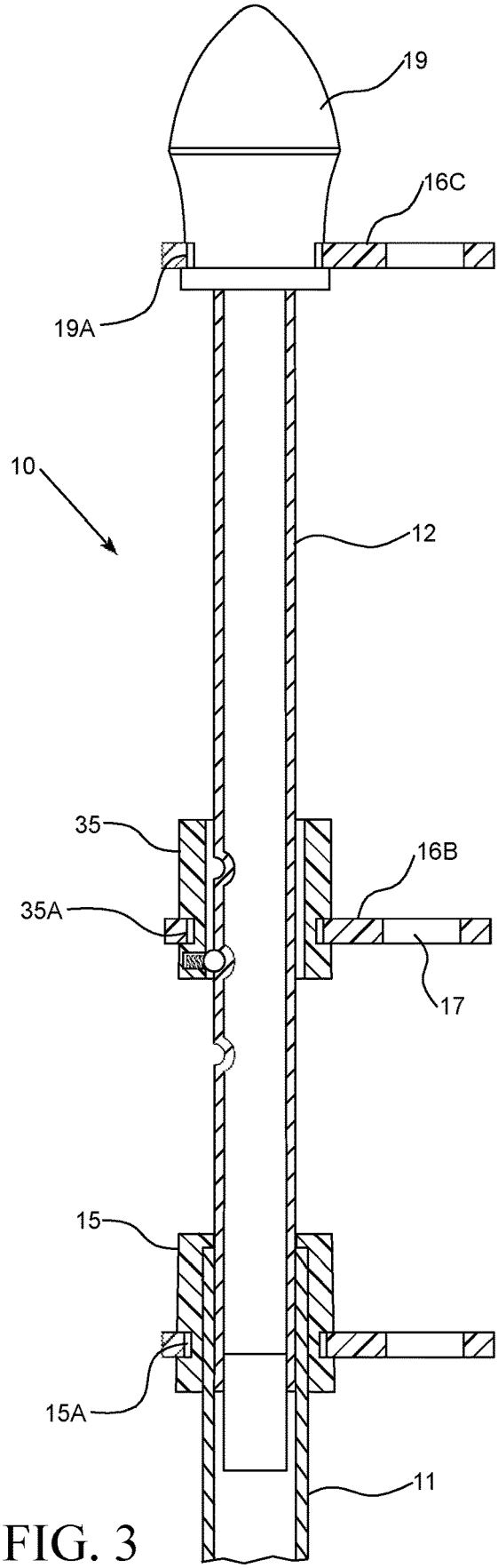
FIG. 3 depicts a top tube section of flagpole comprising a fixed top cap 19, a cap fixed at the joint between the top received tube section 12 and the receiving tube section 11, and an adjustable flagpole clip 35 that is sliding connected to the top tube section 12.

In the embodiment shown in FIGS. 1 and 3, for example, the flagpole comprises a cap 19 on upper end of the received tube section 12 and a cap or cover 15 on the top of the receiving tube section. Cover 15 defines a circumferential channel or groove 15A as shown in FIGS. 2 and 3. A swiveling flag clip 16 is rotatably retained within the circumferential channel 15A. An embodiment of the swiveling flag clip 16 is shown in plan view in FIG. 4. The swiveling flag clip 16 defines an annular aperture 18 that is rotatably retained within the circumferential groove 15A and defines a clip aperture 17 for insertion and retaining a flag connector such as a carabiner, strap, or other connector, for example.

Embodiments of the flagpole may further comprise an adjustable flag connector 35 slidably connected to the top tube section 12. The adjustable flag connector 35 may be locked at different positions along the length of the top tube section 12 by various locking mechanisms. The adjustable flag connector 35 may be moved up or down the top tube section 12 to the desired location based upon the size of the flag or flags connected to the flag pole, for example. In some cases, the flag may be connected to the top fixed connector on cap 19 and the second fixed connector on cap 15.

Further embodiments of the flagpole 1 may comprise a second adjustable flag connector 35 on the second pole section 11. The adjustable flag connector may be the same or different than the adjustable flag pole clip connector on the top tube section 12. In such an embodiment, the top of a first flag may be releasable connected to the fixed flag connector on cap 19 and the bottom of the first flag may be releasably connected to adjustable flag connector 35 on the top tube section 12. Adjustable flag connector 35 may be moved along the top tube section 12 to the desired position and, if desired, locked in that position. The top of a second flag may be releasable connected to the fixed flag connector on cap 15 and the bottom of the second flag may be releasably connected to adjustable flag connector 35 on second tube section 11. For flying a larger flag on the flag pole, the bottom of the first flag may be connected to the fixed flag connector 15 or the adjustable connector 35 on the second tube section 11.

In embodiments, the flagpole 1 may be extended to the desired length. In a preferred embodiment, when the top pole section 12 is fully extended, swiveling flag connector 16C (FIG. 3) and swiveling flag connector 16B or swiveling flag pole connector 16A are a distance apart that is similar to the distance between connection grommets on the flag desired to be flown on the flagpole 10. This allows a flag to be conveniently connected to the top of flag pole.

Many flags have a height of three feet and a width of five feet. Therefore, in an embodiment of the flagpole 10, swiveling flag connector 16C and swiveling flag connector 16A are approximately three feet apart in the fully extend position of pole section 12.

In such an embodiment, the flagpole 10 may be configured to fly a smaller flag, such as a two-foot by three-foot flag, by only extending top tube section partially so that swiveling flag connector 16C and swiveling flag connector 168 are approximately two feet apart. Other embodiments may comprise larger or smaller distances between the flag pole clips when the flag pole is its fully extended position to accommodate larger or smaller flags as desired.

The embodiment of the flagpole may be configured to fly two flags simultaneously. The top tube section 12 and the adjacent tube section 11 may be extended to accommodate the specific flags to be flown. In such an embodiment, a top flag may be connected to a swiveling flag connector 16B and swiveling flag connector 16C and the bottom second flag may be connected to swiveling flag connector 16A and swiveling flag connector 160. The swiveling flag connector 16B may comprise one clip or carabiner for connecting to both flags or swiveling flag connector 16B may comprise an additional clip hole wherein a second clip or carabiner may be attached. One of the clips or carabiners may be attached to the top flag and the second clip or carabiner may be attached to the second lower flag, for example.

In a further embodiment, the cap 15 may comprise two circumferential channels 15A wherein a top swiveling flag connector is within the top circumferential channel and a bottom swiveling flag connector is rotatably connected within the bottom circumferential channel. In such an embodiment, a clip or carabiner can be connected to each swiveling flag connector for connecting to each flag.

Every cap at the joint between a received tube section and a receiving tube section of the telescoping flagpole may define at least one circumferential groove and a swiveling flag connector received within the circumferential groove. For example, a flagpole comprising seven telescoping sections may have seven swiveling flag connector and, optionally, associated adjustable flag clip for flying a plurality of flags. Each swiveling flag connector may be capable of connecting to two flags or each cover, or at least each intermediate cover, may comprise two swiveling flag connectors.

Figure 4:
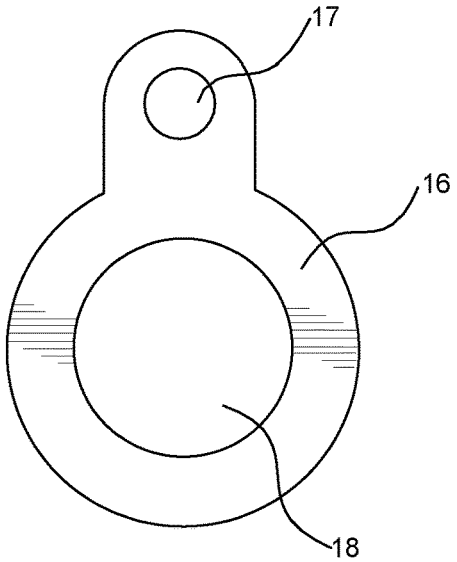
FIG. 4 is a plan view of the flagpole connector 17 shown in FIG. 3.
Figure 5A:
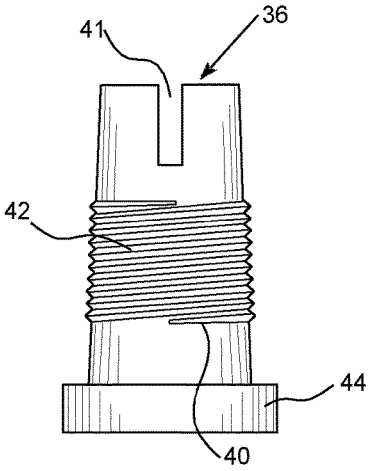
FIG. 5A depicts an elevation view of a threaded body of an adjustable flagpole clip.
Figure 5B:
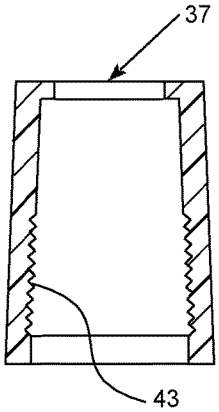
FIG. 5B depicts an elevation view of a threaded locking cap that may be connected to the threaded body of an adjustable flagpole clip.
Figure 5C:
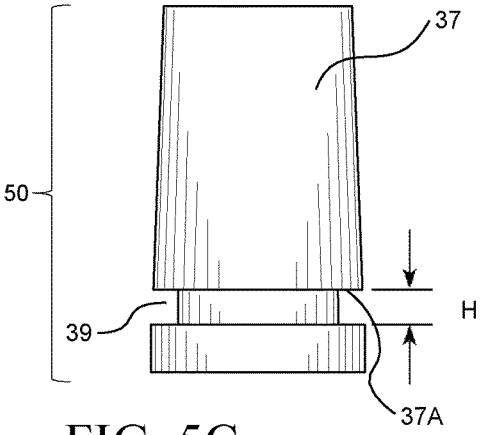
FIG. 5C depicts an elevation view of the threaded locking cap on the threaded body of an adjustable flagpole clip and defining a circumferential groove having a height H.
Figure 5D:
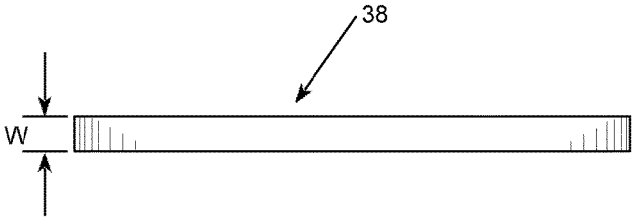
FIG. 5D depicts an elevation view of a flagpole flag connector having a width W.
Figure 5E:
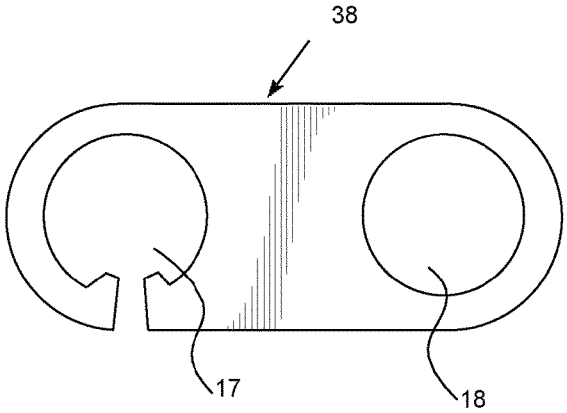
FIG. 5E depicts a plan view of a flagpole flag connector of FIG. 5D.
Figure 5F:
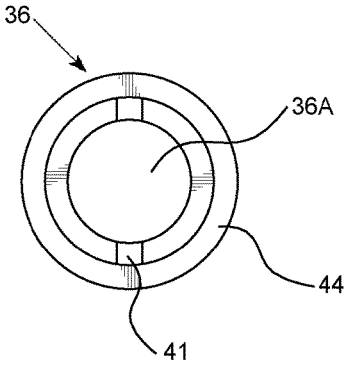
FIG. 5F depicts a plan view of the threaded body of an adjustable flagpole clip of FIG. 5 A.

A swiveling flag pole clip 16 is shown in FIG. 4. The swiveling flagpole clip 16 defines an aperture 18 to be rotatably received and retained within any of the circumferential grooves 15A 19A or 35A and a flag clip aperture 17 to attach a flag or a flag connector such as straps, carabiner, clips, or another flag connector.

An embodiment of an adjustable flagpole clip 35 is shown in FIGS. 5A through 5F. In embodiments the adjustable flagpole clip may be slidably connected to a tube section may comprises a locking mechanism. The locking mechanism will prevent the adjustable flagpole clip 35 being moved from its desired position by the force of the wind exerted on the flag and the adjustable flagpole clip 35. The first adjustable flagpole clip 35 on the top tube section 12 and the second adjustable flagpole clip 35 on the second tube section 11 comprise a releasable locking mechanism. In the embodiment shown in FIGS. 1, and 5A through 5E, the first and second adjustable flagpole clips 35 comprise a releasable locking mechanism 50. The releasable locking mechanisms 50 comprises a threaded body 36 defining a tube aperture 36A and a threaded locking cap 37. A tube section is inserted through the tube aperture 36A to slidably connect the adjustable flagpole clip on the tube section.

The adjustable flagpole clip further comprises a flag clip 38 defining a flag clip aperture 18 that is received over the threaded body 36 and rests on a bottom protrusion 44. The flag clip 38 further defines a flag connector 17. The flag clip 38 has a width W.

After the flag clip 38 is received over the threaded body 36, a threaded cap 37 has internal threads 43 is threaded onto the external threads 42 on the threaded body 36. As the threaded cap 37 is tightened over the threaded body 36, an inner surface of the threaded cap 37 contacts an outer surface of a top portion of the threaded body 36 to squeeze the compression groove 41 and reduce the diameter of the tube aperture 36A to lock the adjustable flagpole clip 35 onto the associated tube section.

A bottom surface 37A of the threaded locking cap and the bottom protrusion define a circumferential gap 39 in the locking mechanism. The flag clip 38 is rotatably retained within the circumferential gap 39. The circumferential gap 39 comprises a height H.

The threaded body 36 further comprises a stop 40. The stop 40 prevents the threaded cap 37 from being threaded onto the threaded body 36 far enough to reduce the height H of the circumferential gap 39 to be less than the width W of the flag clip 38. With the height H greater than width W, the flag clip is ensured to be able to be rotatably retained in the circumferential gap 39.

Thus, in such an embodiment, the flagpole clip is retained in the circumferential gap and the stop prevents the locking cap from being threaded on the threaded body to reduce the height of the circumferential gap to less than a width of the flagpole clip and the flagpole clip may rotate freely within the circumferential gap of the locking mechanism. The treaded cap, however, may be threaded sufficiently onto the threaded body to squeeze at least one compression groove to reduce the diameter of the pole aperture and allow the threaded locking cap to compress a top portion of the threaded body to grip a flagpole tube section.

The embodiments of the described methods and the flagpoles are not limited to the embodiments, components, method steps, and materials disclosed herein as such components, process steps, and materials may vary. Moreover, the terminology employed herein is used to describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be affected within the scope of the invention as defined in the appended claims. Accordingly, the scope of the various embodiments of the present invention should not be limited to the above discussed embodiments and should only be defined by the following claims and all equivalents.

The invention claimed is:

1. A telescoping flagpole, comprising:

a top tube section of the telescoping flagpole, wherein the top tube section comprises a first cap fixedly connected on a top end of the top tube section, wherein the first cap comprises a first cap body, a first circumferential groove defined in the first cap body and a first flag connector rotatably received within the first circumferential groove;

a second tube section of the telescoping flagpole, wherein the top tube section is slidingly received within a top end of the second tube section and the second tube section comprises a second cap cover fixedly connected to top end of the second tube section, wherein the second cap cover comprises a second cap cover body, a second circumferential groove defined in the second cap cover body and a second flag connector rotatably received within the second circumferential groove; and a first adjustable flag clip slidingly received around the top tube section, wherein the first adjustable flag clip comprises a third body, a central aperture defined in the third body, a third circumferential groove defined in the third body, and a third flag connector rotatably received within the third circumferential groove; and a second adjustable flag clip slidingly received around the second tube section, wherein the second adjustable flag clip comprises a fourth body, a central aperture defined by the fourth body, a fourth circumferential groove defined in the body, and a fourth flag connector rotatably received within the fourth circumferential groove.

2. The telescoping flagpole of claim 1, wherein the first cap body comprises a cylindrical section that defines the first cylindrical groove and the second cap body comprises a second cylindrical section that defines the second cylindrical groove.

3. The telescoping flagpole of claim 1, wherein the third flag connector and the fourth flag connector comprise a releasable locking mechanism.

4. The telescoping flagpole of claim 3, wherein each of the releasable locking mechanism comprises a threaded body and a threaded locking cap.

5. The telescoping flagpole of claim 4, wherein the threaded body comprises a bottom protrusion and a stop and a bottom surface of the threaded locking cap and the bottom protrusion define a circumferential gap in the locking mechanism.

6. The telescoping flagpole of claim 5, wherein the third flag connector is retained in the circumferential gap and the stop prevents the locking cap from being threaded on the threaded body to reduce the height of the circumferential gap to less than a width of the third flag connector.

7. The telescoping flagpole of claim 6, wherein the third flag connector may rotate freely within the circumferential gap of the locking mechanism.

8. The telescoping flagpole of claim 7, wherein the third flag connector defines an aperture and the threaded body is received within the aperture.

9. The telescoping flagpole of claim 5, wherein the threaded body defines at least one compression groove that allows the threaded locking cap to compress a top portion of the threaded body to grip a flagpole section.

* * * * *